United States Patent [19]

Pretorius

[11] 4,342,459

[45] Aug. 3, 1982

[54] TETHERED BALL GAME APPARATUS HAVING ECCENTRIC TENSIONING MEANS

[75] Inventor: Willem J. Pretorius, Roodepoort, South Africa

[73] Assignee: Christopher P. Bath, Johannesburg, South Africa; a part interest

[21] Appl. No.: 185,639

[22] Filed: Sep. 9, 1980

[30] Foreign Application Priority Data

Mar. 28, 1980 [ZA] South Africa ..... 80/1845

[51] Int. Cl.[3] ..... A63B 69/40

[52] U.S. Cl. ..... 273/413; 273/26 EA; 273/29 BE; 256/38

[58] Field of Search ..... 273/413, 26 E, 26 EA, 273/29 A, 29 BC, 29 BD, 29 BE, 29 BF, 29 BG; 256/38, 42; 373/333

[56] References Cited

U.S. PATENT DOCUMENTS

| | | | |
|---|---|---|---|
| 118,293 | 8/1871 | Stephens | 256/38 |
| 605,496 | 6/1898 | Manning | 256/38 |
| 971,470 | 9/1910 | Peall | 273/333 |
| 3,924,855 | 12/1975 | Pretorius | 273/413 |

*Primary Examiner*—William H. Grieb

*Attorney, Agent, or Firm*—Sughrue, Mion, Zinn, Macpeak & Seas

[57] ABSTRACT

Ball game apparatus comprising a pair of posts adapted to support a transverse flexible filament therebetween, at least one of such posts having an attachment point for the filament provided on a member pivotally attached to the post with the attachment point and pivot being spaced apart, said member being gravitationally biased to a predetermined position in which the filament is to be in an initial taut condition in use and being such that when the filament is pulled the moment of force about the pivot tends to return the filament to the initial taut condition.

13 Claims, 4 Drawing Figures

TETHERED BALL GAME APPARATUS HAVING ECCENTRIC TENSIONING MEANS

This invention relates to ball game apparatus and, more particularly, to apparatus wherein a ball is suspended by a first string which is slidably attached to a second transverse string supported on a pair of spaced posts in the operative orientation.

Various types of apparatus of the above nature have been proposed and all such apparatus have the requirement that means must be provided for enabling said second string to "give" when the ball is struck so as to pull this string transversely. The means used for this purpose thus far and which are known to applicants use weights attached to free ends of the second string which passes over pulleys on the posts so that gravity acts to bias the weights downwardly. This type of biasing has, in applicant's opinion, the undesirable characteristic that a sudden or large pull can cause jerking of the string and undesirable bouncing of the weight. This results in an awkward or erratic movement of the ball.

Springs have also been used but the cost of suitable springs is considered by applicant to be uneconomical and, also, the tension increases as they are extended with undesirable consequences.

It is the object of this invention to provide apparatus of this type which is inexpensive but wherein the forces tending to return the second string to a straight condition will provide for a more advantageous or desirable motion of the ball in use.

In accordance with this invention there is provided ball game apparatus of the above described general type comprising a pair of posts adapted to support a transverse flexible filament therebetween, at least one of such posts having an attachment point for the filament provided on a member pivotally attached to the post with the attachment point and pivot being spaced apart, said member being gravitationally biased to a predetermined position in which the filament is to be in an initial taut condition in use and being such that when the filament is pulled the moment of force about the pivot tends to return the filament to the initial taut condition.

Further features of the invention provide for each post to be provided with a gravitationally biased member as defined; for the member in each case to take the form of a bar pivoted at a suitable position in its length; for each bar to have a diverging arm extending outwardly and downwardly in a direction substantially opposite that in which the filament is to extend; for a ball to be carried at one end of a flexible string having its other end freely slidable along the length of the filament; and for the posts to be adjustable in length.

In order that the invention may be more fully understood, preferred embodiments thereof will now be described with reference to the accompanying drawings in which.

Figure 1:
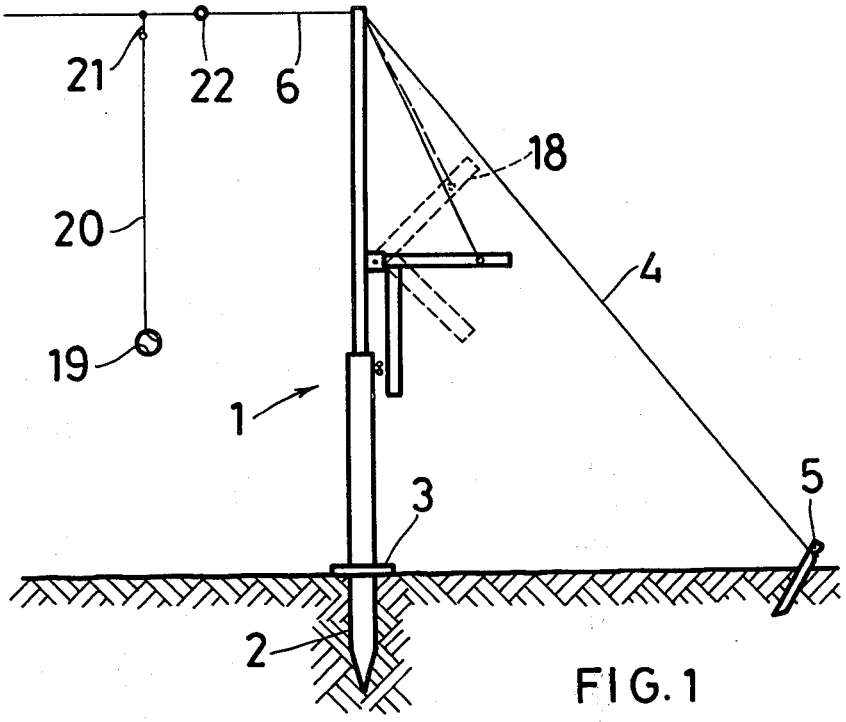
FIG. 1 is a side elevation of one form of post according to the invention.
Figure 2:
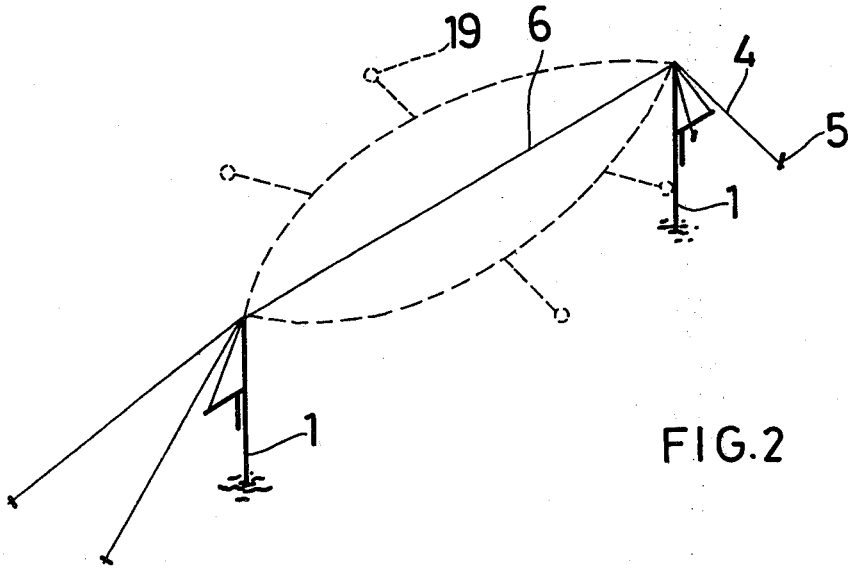
FIG. 2 is an isometric view illustrating the practical use of the apparatus.
Figure 3:
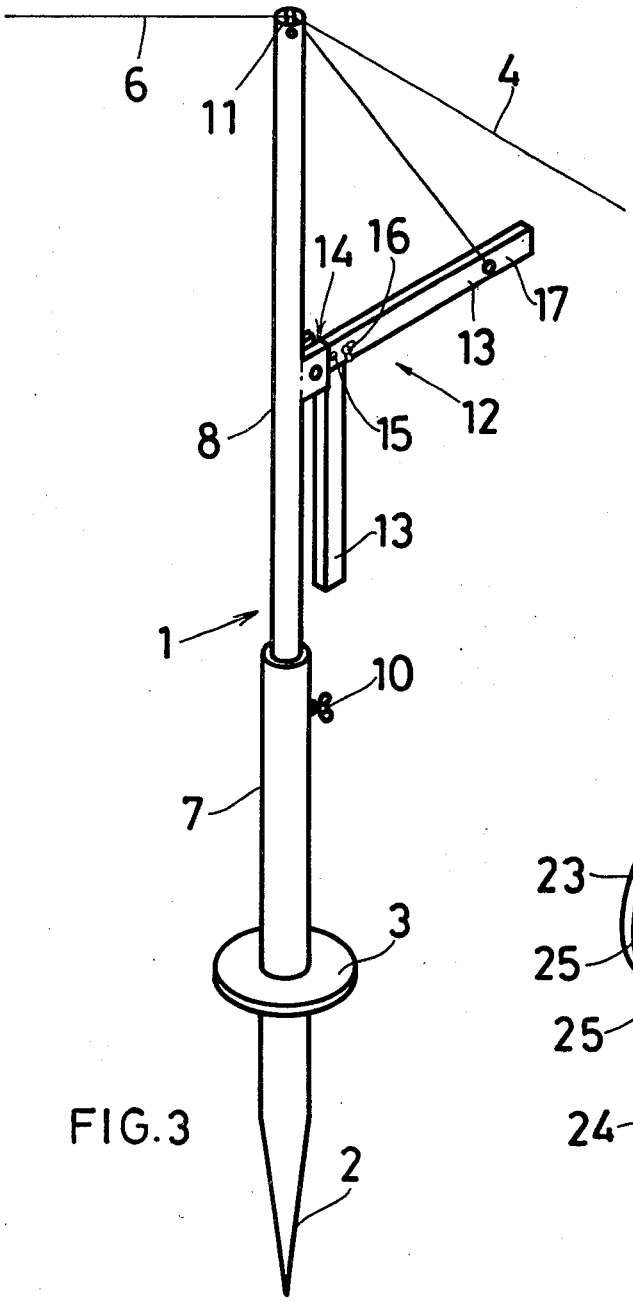
FIG. 3 is an isometric view of the post of FIG. 1.

In the embodiment of the invention illustrated in FIGS. 1 to 3, the apparatus comprises a pair of posts 1 adapted, in any suitable manner, to be located in a substantially vertical orientation for use.

Conveniently corresponding ends of the posts are simply sharpended as shown by numeral 2 in FIG. 3 and in order to facilitate insertion of the sharpened ends to the ground, for example, a rigid annular plate 3 is provided upwardly of the sharpened end 2 secured around the post such that a foot or a pair of feet may engage the plate in order to force the sharpened end into the ground. Preferably, the plate is located at a position in which it will be flush with the ground when the sharpened end of the post has been inserted sufficiently to anchor it adequately.

It is considered to be advisable to provide a flexible stay 4 which can be anchored to the ground by means of a peg 5 and which has its opposite end attached to the upper end of the post as shown clearly in FIG. 1. In use the flexible stays will extend in a direction opposite to that of the main flexible filament 6 to be suspended between the two posts. Preferably, two such stays and pegs are attached to a post.

In order to provide for simple length adjustment of the posts, they can conveniently be made of rolled tubular section as shown clearly in FIG. 3. The post itself in each case consists of two lengths of tubular section rolled mild steel 7 and 8, the smaller of which 8, fits neatly into the other 7. The required adjustability can be provided by way of winged screw 10 which passes through a nut and hole in the larger tubular section 7 and engages against the smaller tubular section 8. The adjustment can then be simply done by loosening the screw 10 and sliding the smaller section up or down to provide the required length.

In this embodiment of the invention the flexible filament 6 passes over a fixed rod 11 or eyelet located at the free end of the small tubular section 8. The fixed rod 11 or eyelet is preferred from a cast point of view and provides a minimal amount of resistance to movement of the flexible filament over it. However, if required a pulley or the like could be provided on the rod 11. Pivotally mounted to the web of the small tubular member 8 is a gravitationally biased member 12 which comprises two bars 13 secured at right angles to each other and a bracing stay securing them in this position. The corner 14 of the member is pivotally attached to the smaller tubular member towards its lower end. Preferably, the two bars are pivotally secured relative to each other by means of a rivet 15, and may thus be folded to be co-planar. They are fixed in right angular operative orientation by a wing nut 16. The one bar thus extends outwardly substantially horizontally whilst the other is directed downwardly in a roughly vertical orientation.

The flexible filament 6 has its free end secured to the free end of the substantially horizontal bar as indicated by numeral 17 in FIG. 3. It will be understood that if the flexible filament 6 is pulled, the gravitationally biased member 12 will rotate upwardly as shown by dotted lines 18 in FIG. 1. This provides the desired amount of "give" to the flexible filament in use and the actual amount of "give" will, of course, depend on the distance between the pivot point and the position 17 where the flexible filament is secured to the gravitationally biased member.

In use a ball 19 is attached to the flexible filament by means of a flexible string 20 with a swivel and eye assembly 21 being located on the flexible filament so that the whole ball and string assembly can move freely longitudinally on the flexible filament. Stops 22 are provided in the filament spaced from the posts by a distance at least equal to the length of the string 20. The swivel and eye will prevent the flexible string 20 becoming twisted along its axis. For use the posts are installed at a suitable distance apart, for example, 15 to 20 meters apart, and the flexible string is attached to the gravitationally biased members as outlined above with the flexible filament passing over the fixed rod 11 at the upper end of each post. A person located near one end of the flexible filament can then strike the ball with a racquet or bat, for example, so that it will move along the flexible filament 6. The ball may be struck so that it has a transverse component to its movement and the ball will then travel along a curvilinear path toward the opposite post. The tendency of the ball to move in a transverse direction will cause the flexible filament to increase in length by moving the gravitationally biased members upwards about their pivoted mountings. As the gravitationally biased members then move down again under the force of gravity the ball will be pulled inward. The ball will thus follow a smooth curve between the two posts.

It will be appreciated that the ratio of the weight of the gravitationally biased members relative to that of the filament and ball is of vital importance for the correct operation of the apparatus. A member too light will cause the flexible filament to extend in length for too long a period of time whilst a member too heavy will not allow the flexible filament to extend sufficiently in length and the ball will thus tend to oscillate from side to side along the filament, during its travel to the opposite post.

The second post may be located so that the ball will strike a wall or the like and return to the person who struck it originally. In such a case, the second post may be suitably modified to be carried by a bracket adapted to be secured to a wall to support the post. Thus, the post would only extend between the pivot and fixed rod or eyelet thereby leaving the wall free of a post which could interfere with the movement of the ball.

Alternatively, a second player may be located at or towards the other end of the flexible filament in which case the object is for him to strike the ball when it reaches him and thereby cause the ball to return to the player who originally struck it. The height of the posts can be adjusted to suit players by adjusting the post length as described above, and the stops 22 prevent the ball and string from becoming entangled around a post.

It is considered that the above described apparatus is simple and inexpensive to construct whilst providing a desirable movement to the ball in use.

Figure 4:
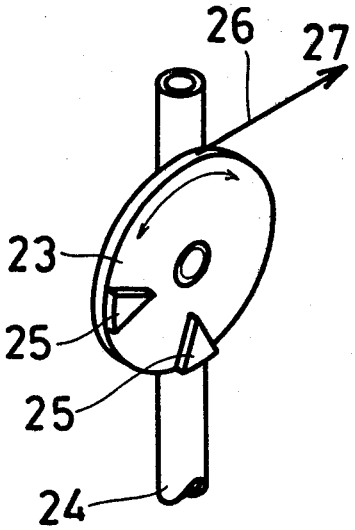
FIG. 4 is an isometric view of an alternative gravitationally biased member.

Other gravitationally biased members may also be provided and one alternative is illustrated in FIG. 4. In this case a large diameter pulley 23 is attached centrally to a post 24 to be located in a vertical plane. The pulley 23 is provided with suitable counterweight 25 which ensures that it assumes a predetermined position in use. The weights 25 are spaced apart to provide a more even movement of force about the pulley than would be obtainable from a single weight.

The flexible filament 26 in this case passes around the pulley and is attached thereto at a position say, for example, near the counterweights 25. In this case when the flexible filament is pulled in the direction indicated by arrow 27 the pulley will rotate against the action of the counterweights which therefor tend to return it to a position in which the flexible filament is straight.

It will be understood that many other gravitationally biased members are possible within the scope of this invention which is confined only to the fact that such a member is pivotally attached to a post.

What I claim as new and desire to secure by Letters Patent is:

1. Ball game apparatus, comprising: a pair of horizontally spaced posts adapted to support a transverse flexible filament therebetween, a member pivotally mounted to at least one of said posts and having an attachment point for an end of said flexible filament, said attachment point and said pivotal mounting being spaced apart, and said member directly embodying means for eccentrically weighting the member relative to its pivotal mounting to gravitationally bias said member to a predetermined position in which the filament is in an initial taut condition in use, whereby when the filament is pulled the moment of force about the pivotal mounting tends to return the filament to the initial taut condition.

2. Ball game apparatus as claimed in claim 1 in which each post has a gravitationally biased member.

3. Ball game apparatus as claimed in claim 1 in which the gravitationally biased member comprises a bar pivoted at one end and having a diverging arm extending outwardly and downwardly substantially opposite that in which the filament extends.

4. Ball game apparatus as claimed in claim 2 in which a ball is provided carried at one end of a flexible string having its other end freely slidable along the length of the filament.

5. Ball game apparatus as claimed in claim 4 in which the free end is attached by means of a swivel eyelet to the filament.

6. Ball game apparatus as claimed in claim 4 in which a stop is located in the filament at a distance from each post at least equal to the length of the flexible string.

7. Ball game apparatus as claimed in claim 3 in which the bar and arm are pivotally secured to each other to be foldable, and are releasably securable in a position at right angles to each other.

8. Ball game apparatus as claimed in claim 1 in which at least one peg and at least one co-operating flexible stay is provided, being adapted to be secured at one end to the peg and at the other end to the top region of a post.

9. Ball game apparatus as claimed in claim 1 in which the posts are adjustable in length.

10. Ball game apparatus as claimed in claim 9 in which each post comprises two tubular sections, one being axially slidable within the other, and securable in any position of slide by a radial screw.

11. Ball game apparatus as claimed in claim 1 in which at least one post has a fixed pin transversely mounted at the top thereof, over which the filament passes in use to a gravitational biased member.

12. Ball game apparatus as claimed in claim 1 in which the lower ends of the posts in their operative condition have sharpened points, and have an annular flange projecting radially outwardly therefrom at a position upward of the pointed ends.

13. Ball game apparatus as claimed in claims 1 or 2 in which the gravitationally biased member is a counterweighted pulley rotationally secured to a post, having in use the filament passing around and secured to its periphery.

* * * * *